US008051622B2

(12) United States Patent
Dampierre

(10) Patent No.: US 8,051,622 B2
(45) Date of Patent: Nov. 8, 2011

(54) UNINSULATED SECTION SUITABLE FOR PRODUCING INSULATED SECTIONS FOR THERMAL BREAK WINDOW AND DOOR FRAMES AND ASSOCIATED METHOD OF ASSEMBLY

(75) Inventor: Maurizio Dampierre, Ornago (IT)

(73) Assignee: Norsk Hydro ASA, Olso (NO)

( * ) Notice: Subject to any disclaimer, the term of this patent is extended or adjusted under 35 U.S.C. 154(b) by 0 days.

(21) Appl. No.: 12/926,038

(22) Filed: Oct. 22, 2010

(65) Prior Publication Data

US 2011/0094081 A1 Apr. 28, 2011

Related U.S. Application Data

(62) Division of application No. 11/830,180, filed on Jul. 30, 2007, now Pat. No. 7,841,139.

(30) Foreign Application Priority Data

Aug. 2, 2006 (IT) ..... MI2006A01534

(51) Int. Cl.
*E04B 1/00* (2006.01)

(52) U.S. Cl. ..... 52/745.19; 52/204.63

(58) Field of Classification Search ..... 52/476, 52/204.71, 204.69, 204.63, 745.19; 29/4.53
See application file for complete search history.

(56) References Cited

U.S. PATENT DOCUMENTS

| | | | | |
|---|---|---|---|---|
| 3,147,518 | A * | 9/1964 | Horgan, Jr. | 52/476 |
| 4,187,657 | A | 2/1980 | Sukolics | |
| 4,267,673 | A | 5/1981 | Coulston | |
| 4,621,478 | A * | 11/1986 | Phillips et al. | 52/775 |
| 5,058,351 | A | 10/1991 | Dunstan | |
| 5,379,518 | A | 1/1995 | Hopper | |
| 5,579,616 | A | 12/1996 | Farag | |
| 6,205,724 | B1 | 3/2001 | Garling et al. | |
| 2005/0055908 | A1 | 3/2005 | Manzella et al. | |

FOREIGN PATENT DOCUMENTS

| | | |
|---|---|---|
| DE | 8223301 | 12/1982 |
| EP | 0556600 | 8/1993 |
| GB | 2098890 | 12/1982 |
| IT | MI932410 | 4/1997 |

* cited by examiner

*Primary Examiner* — Basil Katcheves
(74) *Attorney, Agent, or Firm* — Nixon & Vanderhye, P.C.

(57) ABSTRACT

An uninsulated section comprising a first section element and a second section element is described; the first section element comprises a first cavity for housing a portion of a first heat-insulating body and a second cavity for housing a portion of a second heat-insulating body; the second section element comprises a third cavity for housing another portion of the first heat-insulating body and a fourth cavity for housing another portion of the second heat-insulating body. The uninsulated section also comprises a partition connecting the first section element and the second section element. Advantageously, the partition may be situated between the first and the second cavity and between the third and the fourth cavity.

7 Claims, 6 Drawing Sheets

UNINSULATED SECTION SUITABLE FOR PRODUCING INSULATED SECTIONS FOR THERMAL BREAK WINDOW AND DOOR FRAMES AND ASSOCIATED METHOD OF ASSEMBLY

This application is a divisional application of U.S. patent application Ser. No. 11/830,180 filed Jul. 30, 2007, now U.S. Pat. No. 7,841,139 which is based on Italian Patent Application No. M12006A 001534 filed on Aug. 2, 2006, the content of which are incorporated hereinto by reference.

BACKGROUND

I. Field of the Invention

The technology disclosed herein relates to the sector of metal sections (typically made of aluminium) for forming window and door frames. In particular, it relates to an uninsulated section which is suitable for producing an insulated section used for the assembly of thermal break window and door frames. The technology disclosed herein also relates to a process for producing, from said uninsulated section, an insulated section for assembling thermal break window and door frames.

II. Related Art and Other Considerations

Various metal sections, which are typically made of aluminium, are known to be used in order to form frames for doors, windows or partitions. In particular, cold or uninsulated sections are known where metallic continuity exists between the section parts exposed to the external environment and the section parts inside a substantially closed environment (for example an apartment). Since aluminium is a good heat conductor, uninsulated sections therefore have the drawback that they allow heat exchange between the interior and exterior.

In order to overcome these drawbacks, for some time insulated sections suitable for forming "thermal break" window and door frames have been known. In thermal break window and door frames, the externally exposed aluminium part is separated from the internal part by means of heat-insulating bodies. A thermal break chamber with walls made of heat-insulating material is formed in these sections. Usually, this material is a plastic material. Typically, this plastic material is polyamide, ABS, PVC or the like. This chamber partially made of plastic material interrupts the transmission of heat by means of conduction between the outer part and inner part and provides the section with a high heat-insulating capacity.

The sections which are currently known for the formation of thermal break window and door frames are obtained by suitably assembling two sections or separate half-shells which are obtained by means of extrusion inside two separate extruders. The thermal break chamber is formed by inserting the end of two polyamide bars inside suitable cavities provided in the two half-shells of the section. Alternatively, heat-insulating bodies with a tubular shape are used. Each of the abovementioned special cavities is delimited by a pair of longitudinal teeth able to be bent or by a bendable longitudinal tooth and a fixed shoulder. During insertion of the bars or the tubular body, the teeth are all open in order to allow precisely easy insertion of the bars or the tubular body, respectively. After inserting the bars or the tubular body inside the respective cavities, the semi-finished section (comprising the two half-shells and the polyamide bars loose inside the respective cavities) is processed by a rolling machine. The rolling machine bends slightly the teeth of both cavities and ensures firm fastening together of the bars, or the tubular body, made of heat-insulating material and the half-shells.

This solution has the drawback that assembly is fairly laborious and difficult to automate completely. Even where it is automated, assembly results in long processing times owing to the need to carry out a lot of manual checks. The two separated half-shells must be moved close together to allow insertion of the polyamide bars inside the appropriate seats of both half-shells. They are then passed through a rolling machine which bends the teeth and fixes the polyamide bars in position. This laborious assembly process which cannot be completely automated results in high costs.

Another disadvantage of the abovementioned known solution is that associated with the machining tolerances. The problem arises from the fact that the two half-shells are typically extruded using two different extruders. During assembly the problem may arise of not managing to assemble the two half-shells (or of assembling them in an imperfect manner) if the tolerances of one or other half-shell are excessive. EP 0,653,541 discloses an uninsulated section which allows the production of an insulated section for thermal break window and door frames.

The section according to EP 0,653,541 eliminates some of the problems mentioned above. In particular, it is advantageous because it is obtained by extruding a single section from a single extruder or die. This allows the machining tolerances to be kept small.

However, assembly of the section according to EP 0,653,541 is also difficult to automate completely. In fact, firstly it is necessary to insert the heat-insulating elements in the appropriate seats. Then, using at least two different tools, the walls 9 which connect the inner half-shell to the outer half-shell are cut. This operation is long and results in a not insignificant amount of waste material. Moreover, the cutting step must be performed in a very precise manner in order to avoid damaging the teeth 11 and the parts made of heat-insulating material. Another drawback consists in the impossibility of knurling the bottom of the cavities which house the heat-insulating elements and therefore the adhesion is not perfect. A further drawback consists in the impossibility of using heat-insulating elements of different forms and sizes. In other words, it is not possible to use longer heat-insulating elements which space by a greater amount the inner half-shell from the outer half-shell.

BRIEF SUMMARY

One object of the technology disclosed herein is to provide an uninsulated section suitable for producing an insulated section used for the assembly of thermal break window and door frames, which solves the abovementioned problems. Another object of the technology disclosed herein is to provide a process for producing, from said uninsulated section, an insulated section for assembling thermal break window and door frames.

These and other objects are achieved by an uninsulated section comprising a first section element and a second section element; the first section element comprises a first cavity for housing a portion of a first heat-insulating body and a second cavity for housing a portion of a second heat-insulating body; the second section element comprises a third cavity for housing another portion of the first heat-insulating body and a fourth cavity for housing another portion of the second heat-insulating body. The uninsulated section also comprises a single partition connecting the first section element and the second section element.

Preferably, the partition is situated between the first and the second cavity and between the third and the fourth cavity. Typically, the first section element is an inner section element and the second section element is an outer section element.

According to one embodiment, the connecting partition is of the type with a double arrow head. Alternatively, the connecting partition may not have arrow heads at its ends.

Conveniently, the first cavity is formed on one side of the first section element and is delimited by a tooth and by the connecting partition; the second cavity is formed on the same side of the first section element and is delimited by a tooth and by the connecting partition; the third cavity is formed on one side of the second section element and is delimited by a tooth and by the connecting partition; and the fourth cavity is formed on the same side of the second section element and is delimited by a tooth and by the connecting partition.

The teeth can be preferably bent towards the respective heat-insulating body.

According to a variant, the first and the second heat-insulating bodies are joined together to form a single tubular heat-insulating body.

Preferably, the section is made of aluminium or aluminium alloy. Obviously it is possible to use other metals or alloys, such as steel or steel alloys for example.

According to a second aspect of the technology disclosed herein, a process for producing an insulated section from an uninsulated section is provided, the process comprising the steps of:

a) providing an uninsulated section comprising a first section element and a second section element; the first section element comprises a first cavity for housing a portion of a first heat-insulating body and a second cavity for housing a portion of a second heat-insulating body; the second section element comprises a third cavity for housing the other portion of the first heat-insulating body and a fourth cavity for housing the other portion of the second heat-insulating body, in which said uninsulated section also comprises a single partition connecting said first section element and said second section element.

b) cutting said single partition, and f) inserting heat-insulating bodies inside the cavities.

Each cavity may be delimited by a tooth. The process conveniently comprises the step g) of bending said teeth after inserting said heat-insulating bodies in order to fix them in position.

The process may comprise the step d) of roughening the bottom of said cavities.

The step d) of roughening the bottom of said cavities may comprise the step of knurling the bottom of the cavities. This step may be preceded by a step c) of moving the first section element away from the second section element and may be followed by the step e) of moving the first section element back towards the second section element.

BRIEF DESCRIPTION OF THE DRAWINGS

The technology disclosed herein will become clear from the following detailed description, provided purely by way of a non-limiting example, to be read with reference to the accompanying tables of drawings in which.

DETAILED DESCRIPTION

Figure 1:
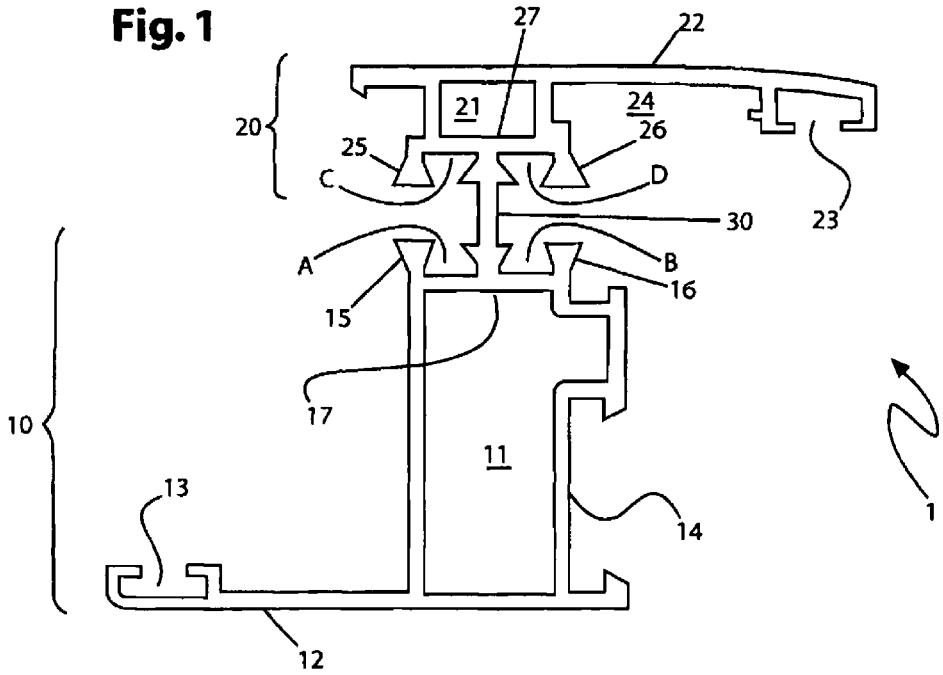
FIG. 1 is a cross-section through the uninsulated section according to an example embodiment of the technology disclosed herein.
Figure 7:
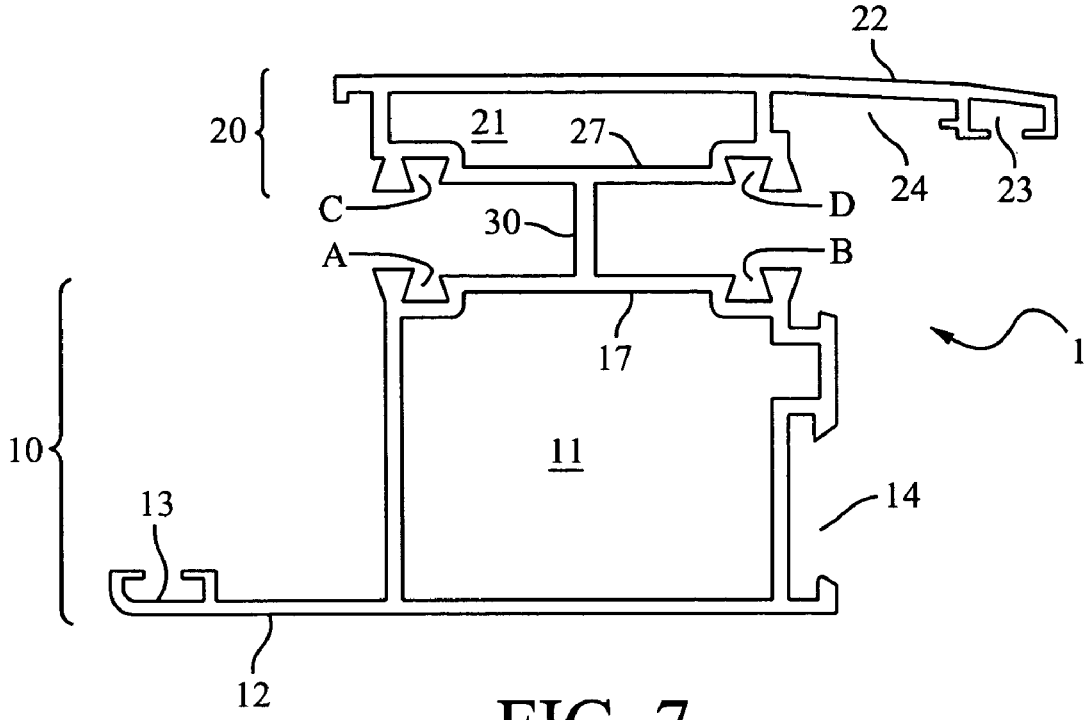
FIG. 7 is a cross-section through the uninsulated section according to a second example embodiment of the technology disclosed herein.

FIG. 1 shows schematically an uninsulated section 1 which is suitable for producing an insulated section 1' used for the assembly of "thermal break" window and door frames. It should be pointed out that the section 1 according to FIG. 1 is shown solely by way of illustration. In fact, the inner section part 10 and the outer section part 20 may assume forms different from those shown in the accompanying figures. FIG. 7 shows a second embodiment of an uninsulated section 1 which is also suitable for producing an insulated section 1' used for the assembly of thermal break window and door frames.

The uninsulated section 1, which is shown purely by way of example, is substantially Z-shaped.

The inner section part 10 comprises a chamber 11 with a closed cross-section which is approximately rectangular. The inner section part 10 also comprises a flange 12 which terminates in a seal-holder seat 13. On the opposite side to that of the flange 12 there is a C-shaped seat 14 for a glass-retaining member, for a hinge member or for a closure locating member (not shown).

The outer section part 20 also comprises a chamber 21 with a closed cross-section and a flange 22 which terminates in a seal-holder seat 23. The flange 22 also defines a recess 24 suitable for receiving an aligning bracket.

The inner section part 10 is connected to the outer section part 20 by means of a connecting partition 30. In this way there exists metallic continuity between the section parts exposed to the external environment (outer section part) and the section parts exposed to the internal environment (inner section part). The drawback is that heat exchange takes place between the inside and the outside.

The connecting partition 30 connects one wall or side 17 of the closed chamber 11 of the inner section part 10 and the corresponding wall or side 27 of the closed chamber 21 of the outer section part 22.

The connecting partition 30 may have, in cross-section, the form of a double arrow head and is situated substantially in the centre of the sides 17, 27 which it connects. At the ends of the opposite sides 17, 27 there are fixing teeth 15, 16, 25, 26 which can be bent. In particular, at the end of the side 17 there is a first fixing tooth 15 and a second fixing tooth 16. At the ends of the side 27 there is a first fixing tooth 25 and a second fixing tooth 26. The connecting partition may not be of the type with a double arrow head, as in the case of the section according to FIG. 7. Thus, the first section element 10 comprises a first section wall 17 having fixing teeth 15, 16 provided at opposing ends thereof. The first section wall 17 at least partially defines both a first cavity A (configured to accommodate a portion of a first heat-insulating body) and a second cavity B (configured to for accommodate a portion of a second heat-insulating body). The second section element 20 comprises second section wall 27 having fixing teeth 25, 26 provided at opposing ends thereof. The second section wall 27 at least partially defines both a third cavity C (configured to accommodate another portion of the first heat-insulating body) and a fourth cavity D (configured to accommodate another portion of the second heat-insulating body). The single connecting partition 30 forms a sole connection between the first section element 10 and the second section element 20. The single connecting partition 30 is configured and situated to space apart the first section wall 17 and the second section wall 27 in a manner to provide a cutting line and also to at least partially define each of the first cavity A, the second cavity B, the third cavity C, and the fourth cavity D. Moreover, the single connection partition 30 comprises tapered surfaces which mirror corresponding ones of the fixing teeth 15, 16, 25, and 26 and together with the corresponding fixing teeth 15, 16, 25, and 26 restrict size of a mouth of each of the first cavity A, the second cavity B, the third cavity C, and the fourth cavity D.

Four cavities A, B, C and D for housing heat-insulating bodies (typically, but not necessarily made of polyamide) are thus formed. The cavity A is formed on the side 17 of the inner section part and is delimited by the tooth 15 and by the head of the connecting partition 30; the cavity B is formed on the side 17 of the inner section part and is delimited by the tooth 16 and by the head of the connecting partition 30; the cavity C is formed on the side 27 of the outer section part and is delimited by the tooth 25 and by the head of the connecting partition 30; and the cavity D is formed on the side 27 of the outer section part and is delimited by the tooth 26 and by the head of the connecting partition 30.

The teeth 15, 16, 25 and 26 can be folded towards the respective cavities A, B, C and D in order to fix the heat-insulating bodies (after they have been inserted).

According to the technology disclosed herein, therefore, a single partition 30 connecting the inner section part 10 and the outer section part 20 is provided. The single connecting partition may be central (as in the case of the section according to FIG. 1 and FIG. 7) or lateral (so as to connect the teeth 15 and 25 or 16 and 26).

Figure 2:
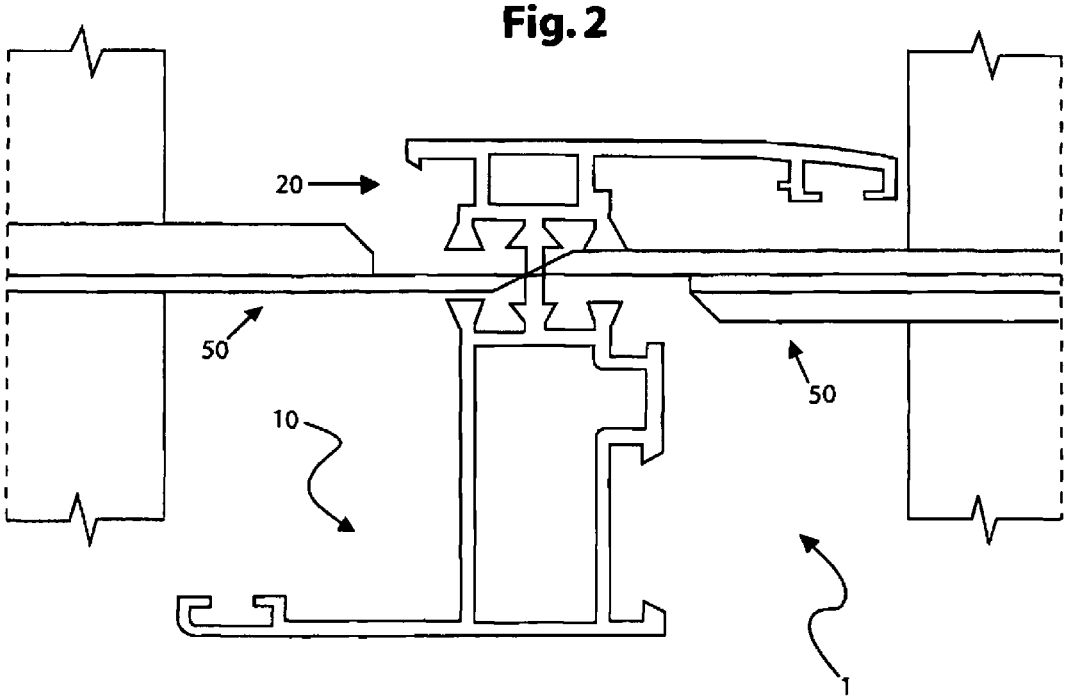
FIG. 2 illustrates the step of cutting the partition which connects the inner section part and the outer section part.

Once this partition 30 has been cut (FIG. 2, cutting tool 50), the inner section part 10 and the outer section part 20 become completely separated. This is shown in FIG. 2. The cut may be performed with a single operation. Advantageously, material does not have to be removed as in the case of EP 0,653,541. In other words, according to the present invention it is sufficient to perform the cut along a single cutting line. On the other hand, in EP 0,653,541 four cuts had to be performed, i.e. two for each wall connecting the inner section part and the outer section part and there was a considerable amount of waste material.

Figure 3:
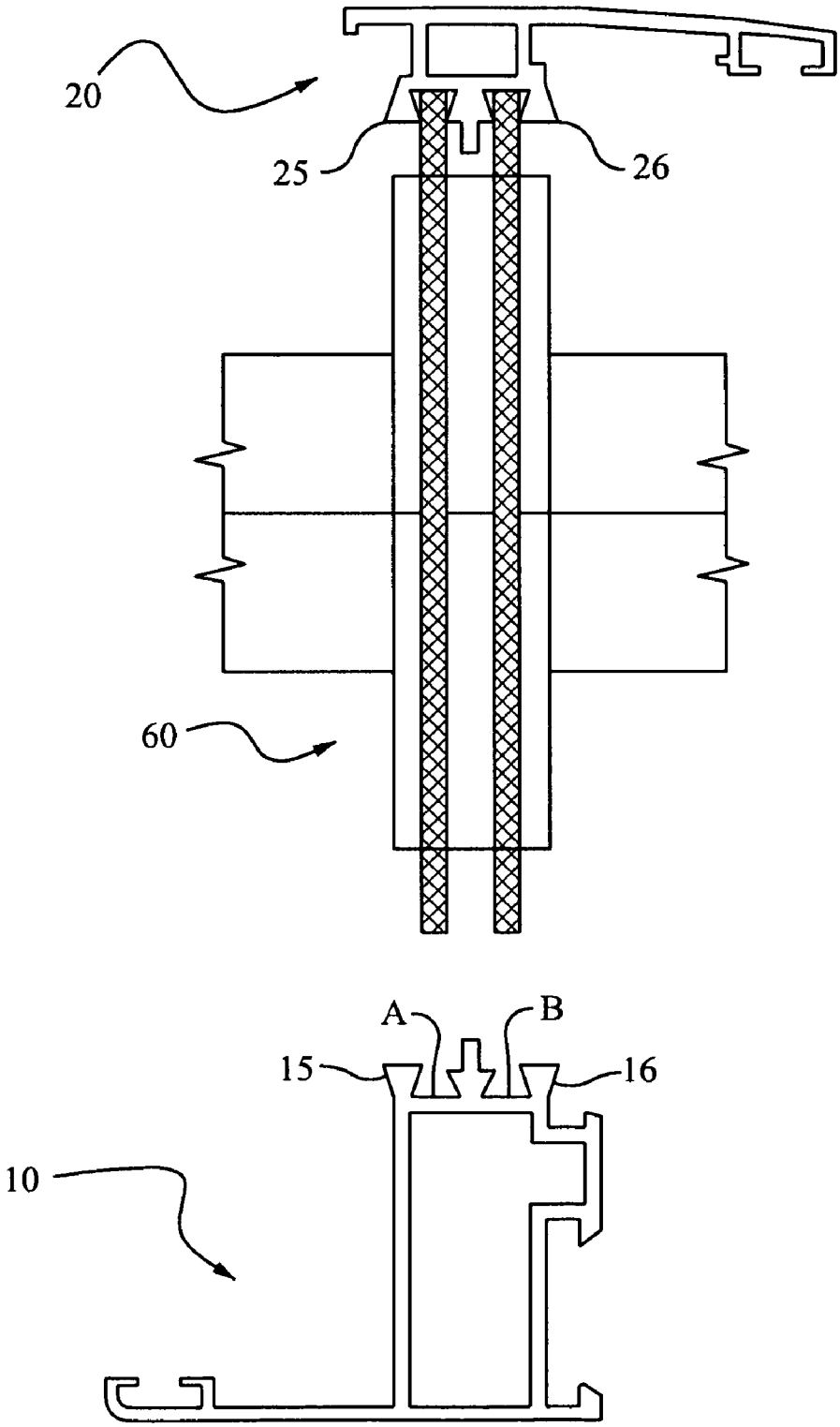
FIG. 3 illustrates the step of knurling the cavities for the heat-insulating bodies of the outer section part (it can be noted that the two section parts have been moved away from each other)
Figure 4:
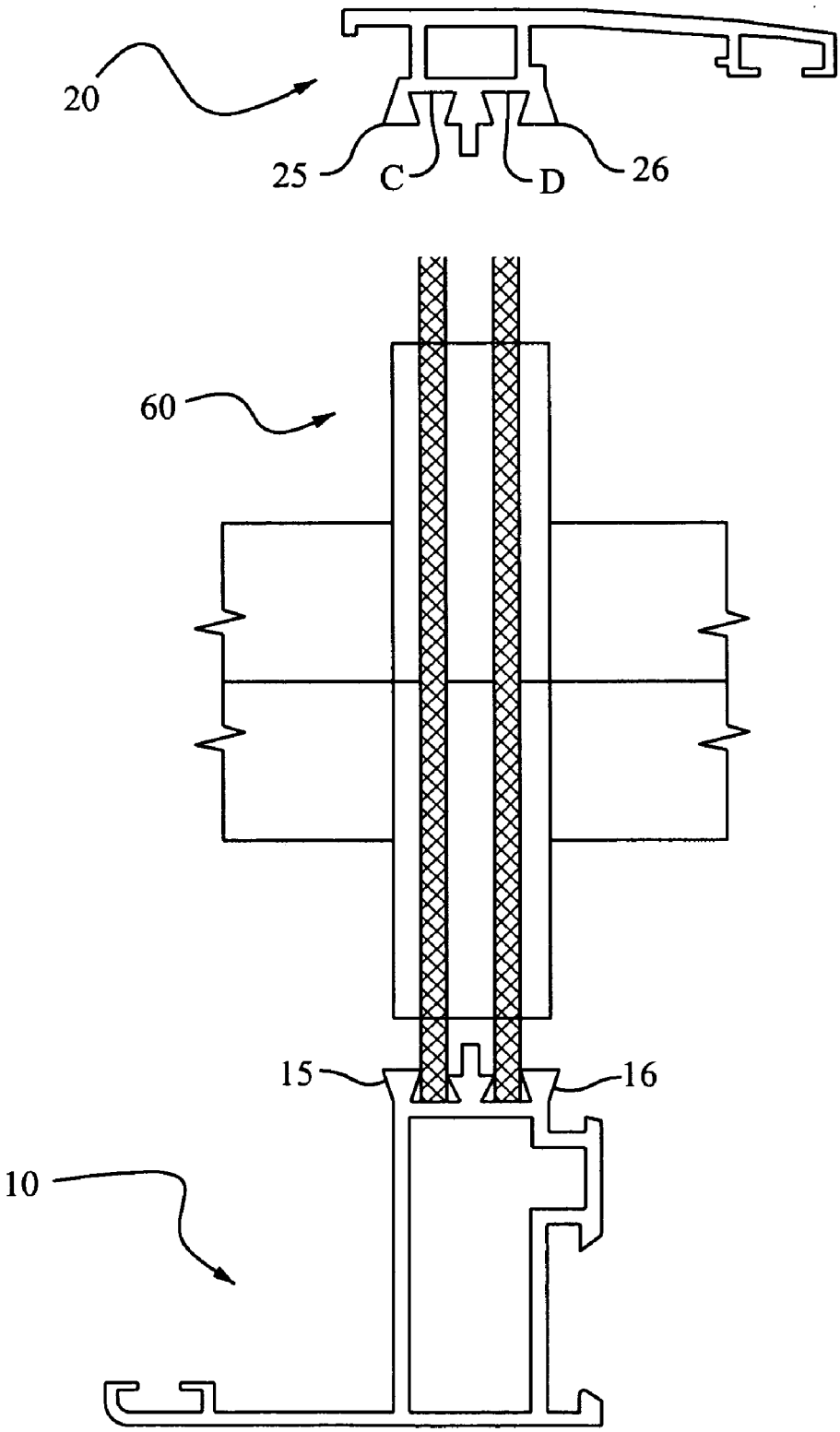
FIG. 4 shows the step of knurling the cavities for the heat-insulating bodies of the inner section part, with the section parts separated from each other.
Figure 5:
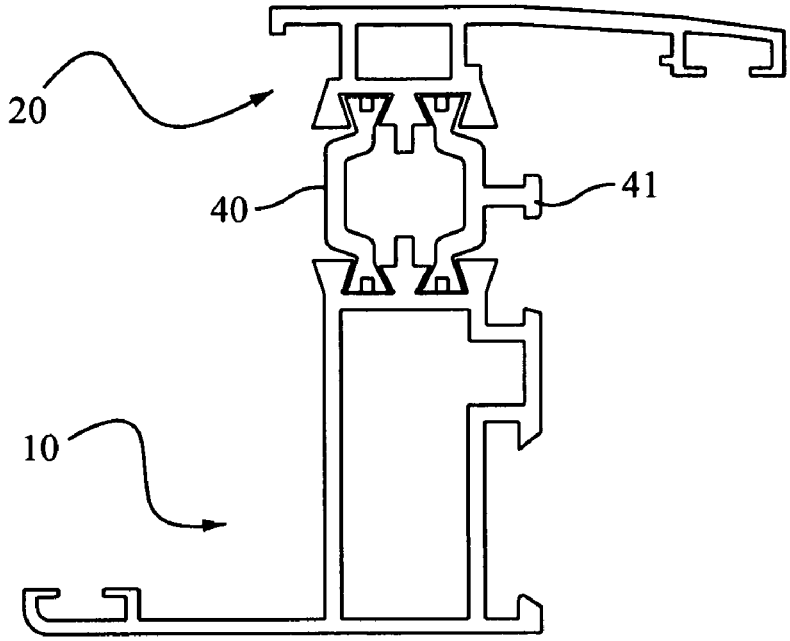
FIG. 5 shows the thermal break section formed from the uninsulated section of FIG. 1, before fixing the heat-insulating bodies.

After performing the cut, the inner section part and the outer section part are preferably separated, whilst nevertheless keeping them facing each other. In this condition, the bottom of the cavities A, B, C and D may be advantageously knurled in order to favour fixing of the heat-insulating body. The knurling operation is shown in FIG. 3 (knurling of the cavities C and D of the outer section part 20) and in FIG. 4 (knurling of the cavities A and B of the inner section part 10). The tools for performing knurling are indicated by the reference number 60. Advantageously, the outer section part and the inner section part are kept facing each other at distance such as to allow the action of the knurling disks. The latter, advantageously, are first passed in one direction in contact with the bottom of the cavities of a section part (for example the outer part) and then passed in the opposite direction in contact with the bottom of the cavities of the other section part (for example the inner part).

After the optional knurling step, heat-insulating bodies 40, 41 are inserted into the appropriate seats A, B, C and D. In the embodiment shown by way of example, two separate bars 40, 41 are provided, their ends being suitable for insertion inside the cavities A, B, C and D. This thus results in the formation of an insulated chamber 42 which interrupts the metallic continuity between the outer section part 20 and the inner section part 10. As an alternative to the solution with two separate bars, other solutions are possible. For example, it is possible to use a single tubular heat-insulating body (not shown) which is also conveniently made of polyamide or similar materials. It is optionally possible to use foam. Another advantage of the invention is that heat-insulating bodies of different sizes, which separate by a greater amount the outer section part from the inner section part, may be used.

Figure 6:
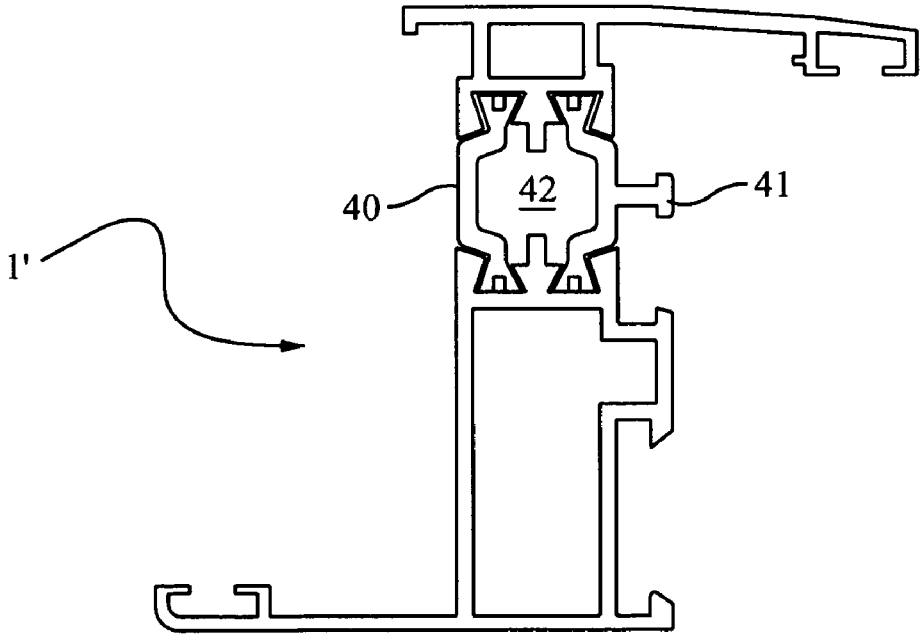
FIG. 6 shows the thermal break section formed from the uninsulated section according to FIG. 1, completely assembled.

When the heat-insulating bars 40, 41 are inserted, the teeth are slightly open outwards and the bars are loose inside the cavities. By means of a rolling operation, the teeth 15, 16, 25, 26 are pushed towards the heat-insulating bars and fix them in position. The result of the rolling operation is shown in FIG. 6.

Figure 8:
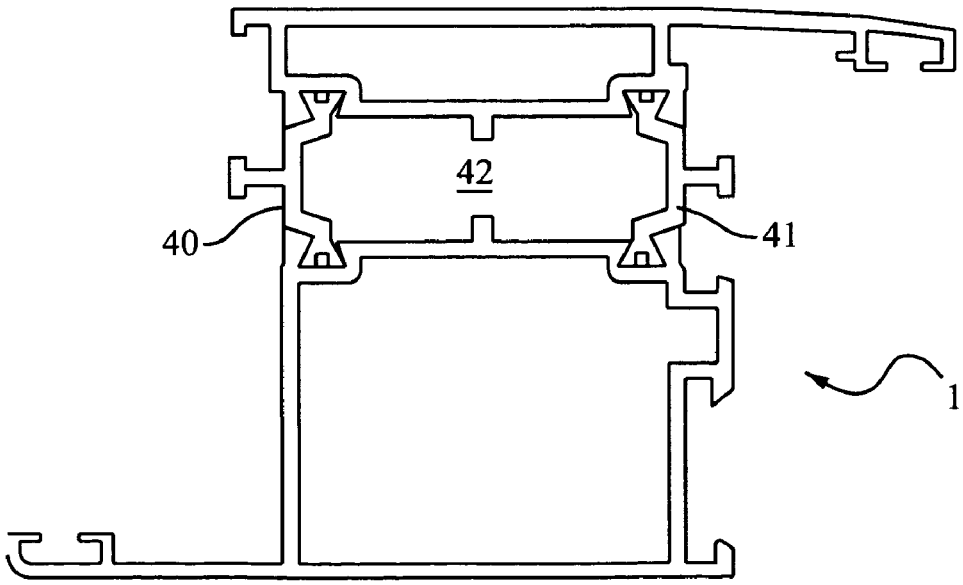
FIG. 8 shows the thermal break section formed from the uninsulated section according to FIG. 7, completely assembled.

FIG. 7 shows a second embodiment of an uninsulated section suitable for producing an insulated section which is used for assembly of thermal break window and door frames. The main difference, as regards the technology disclosed herein, is the fact that the connecting partition does not delimit the cavities A, B, C and D and the connecting partition does not have to be of the type with a double arrow head. In the embodiment of FIG. 7, the first section element 10 comprises a first section wall 17 and a second section wall 27. The first section wall 17 has two bends formed at positions spaced away from two opposite ends of the first section wall 17 and further has fixing teeth provided at the two opposite ends of the first section wall 17. A first cavity A is at least partially defined by a first bend of the first section wall 17 and a first fixing tooth of the first section wall 17. A second cavity B is at least partially defined by a second bend of the first section wall 17 and a second fixing tooth of the first section wall 17. The first cavity A is configured to accommodate a portion of a first heat-insulating body and the second cavity B is configured to accommodate a portion of a second heat-insulating body. The second section element 20 comprises second section wall 27, which has two bends formed at positions spaced away from two opposite ends of the second section wall 27 and further has fixing teeth provided at the two opposite ends of the second section wall 27. A third cavity C is at least partially defined by a first bend of the second section wall 27 and a first fixing tooth of the second section wall 27; a fourth cavity D is at least partially defined by a second bend of the second section wall 27 and a second fixing tooth of the second section wall 27. The third cavity A is being configured to accommodate a portion of the first heat-insulating body and the fourth cavity D is configured to accommodate a portion of the second heat-insulating body. The single connecting partition 30 forms a sole connection between the first section element and the second section element, and is configured and situated to space apart the first section wall 17 and the second section wall 27. When assembled with the heat-insulating bodies, the section according to FIG. 7 appears as shown in FIG. 8.

Figure 9:
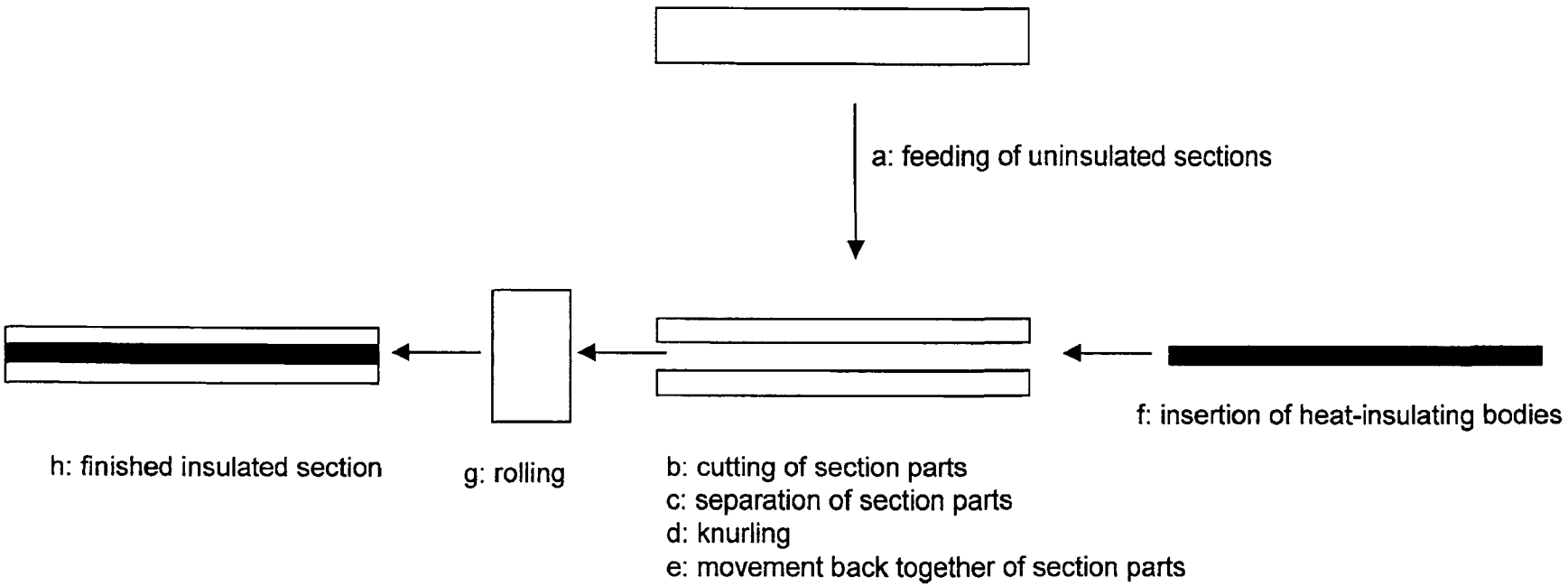
FIG. 9 illustrates schematically the process according to an example mode of the technology disclosed herein.

The assembly process, starting with the uninsulated section according to FIG. 1, may be completely automated and is illustrated schematically in FIG. 9. The uninsulated sections are fed (a), for example via rollers or a conveyor belt. Then the uninsulated section is cut (b) along the connecting partition and inner section part and the outer section part are thus separated. The section parts are moved away from each other (c), while keeping the cavities facing each other. Then the cavities A, B, C and D are knurled (d). Preferably, a first pass is performed with the knurling disks in order to knurl the cavities of a section part and a second pass performed with the knurling disks in order to knurl the cavities of the other section part. The section parts are kept fixed in position. Then the section parts are automatically moved towards each other again (e) until a pre-set distance, depending on the dimensions of the heat-insulating bodies which are to be inserted, is reached. The steps c, d and e are in any case optional, although it is advantageous to perform knurling.

At this point, a machine arranged in series and already known inserts the heat-insulating bodies (I) and the semi-finished section is conveyed (for example by causing it to slide on rollers) to the following fastening step where it undergoes rolling (g) in order to fix the heat-insulating bodies. An insulated section is thus obtained (h). Advantageously, the process for producing an insulated section from an uninsulated section according to the present invention can be made in a continuous manner and in-line.

What is claimed is:

1. A process for producing an insulated section from an uninsulated section, the process comprising the acts of:

a) providing an uninsulated section comprising a first section element and a second section element; wherein the first section element comprises a first cavity for housing a portion of a first heat-insulating body and a second cavity for housing a portion of a second heat-insulating body; wherein the second section element comprises a third cavity for housing the other portion of the first heat-insulating body and a fourth cavity for housing the other portion of the second heat-insulating body, wherein said uninsulated section also comprises a single partition connecting said first section element and said second section element, b) cutting said single partition, c) moving the first section element away from the second section element, d) roughening a bottom of said cavities, e) moving the first section element back towards the second section element; and f) inserting heat-insulating bodies inside the cavities.

2. The process according to claim 1, wherein each cavity is delimited by a tooth, and wherein the method further comprises a act g) of bending said teeth after inserting said heat-insulating bodies in order to fix the teeth in position.

3. The process according to claim 1, wherein act d) comprises knurling the bottom of the cavities.

4. The process of claim 1, wherein each of said first to fourth cavities is delimited by a tooth, and wherein the method further comprises bending said teeth after inserting said heat-insulating bodies in order to fix the teeth in position.

5. A process for producing an insulated section from an uninsulated section, the process comprising:

providing an uninsulated section comprising a first section element and a second section element; wherein the first section element comprises a first cavity for housing a portion of a first heat-insulating body and a second cavity for housing a portion of a second heat-insulating body; wherein the second section element comprises a third cavity for housing the other portion of the first heat-insulating body and a fourth cavity for housing the other portion of the second heat-insulating body, wherein said uninsulated section also comprises a single partition connecting said first section element and said second section element, cutting said single partition by a longitudinal cut so that the first section element becomes completely separated by said second section element, moving the first section element away from the second section element; and inserting heat-insulating bodies inside the cavities.

6. The process of claim 5, wherein each of said cavities comprises a bottom, and wherein the method further comprises roughening the bottom of said cavities.

7. The process of claim 6, wherein said roughening comprises knurling the bottom of said cavities.

* * * * *